United States Patent [19]

Greider

[11] 4,205,468

[45] Jun. 3, 1980

[54] REMOTE CONTROL SNOW BLOWER DISCHARGE CHUTE DEFLECTOR

[75] Inventor: Charles Austin Greider, Des Moines, Iowa

[73] Assignee: AMF Incorporated, White Plains, N.Y.

[21] Appl. No.: 955,662

[22] Filed: Oct. 27, 1978

[51] Int. Cl.[2] ..... E01H 5/04

[52] U.S. Cl. ..... 37/43 R; 406/161

[58] Field of Search ..... 37/43 R–43 L, 37/53; 406/159, 160, 161; 414/617; 193/14, 23, 29, 30, 33; 56/13.3, 13.4, 71, 153, 203

[56] References Cited

U.S. PATENT DOCUMENTS

| | | | |
|---|---|---|---|
| 1,247,480 | 11/1917 | Adams | 406/161 X |
| 2,642,680 | 6/1953 | Curtis et al. | 37/43 E |
| 2,670,839 | 3/1954 | Aasland | 406/161 X |
| 2,735,199 | 2/1956 | Wanner et al. | 37/43 E |
| 3,202,462 | 8/1965 | Segredo | 406/161 |
| 3,423,132 | 1/1969 | Blanton et al. | 406/161 |
| 3,510,171 | 5/1970 | Bacon | 37/43 R X |
| 3,698,576 | 10/1972 | Gillette | 406/160 X |
| 4,011,668 | 3/1977 | Gunderson | 37/43 R |

FOREIGN PATENT DOCUMENTS

| | | | |
|---|---|---|---|
| 998919 | 6/1974 | Canada | 37/43 R |

*Primary Examiner*—E. H. Eickholt

*Attorney, Agent, or Firm*—George W. Price; Walter Lewis

[57] ABSTRACT

The discharge chute deflector is operated in both directions by positive means comprising a pull cable for elevating it and a spring for lowering it, the spring being tensioned when the deflector is raised, by a rod connected to the deflector and spring.

3 Claims, 3 Drawing Figures

REMOTE CONTROL SNOW BLOWER DISCHARGE CHUTE DEFLECTOR

This invention relates to snow blowers, and more particularly, to a remote control discharge chute therefor.

In many snow blowers it is necessary to stop the device and come from behind the device to the front thereof in order to change the direction of the discharge. It is by far better from the standpoint of safety and convenience for the operator to not leave his position behind the blower and at the controls thereof in order to change the direction of the discharge.

Therefore, it is an object of this invention to provide a snow blower discharge chute deflector which can be controlled from the operator's position behind the blower and at the controls thereof, and in a manner which is low cost, uncomplicated and reliable.

Briefly, in the invention a mechanism using a minimum of parts is provided on the discharge chute for adjusting the deflector simply by operating a control handle from a position behind the blower.

Figure 1:
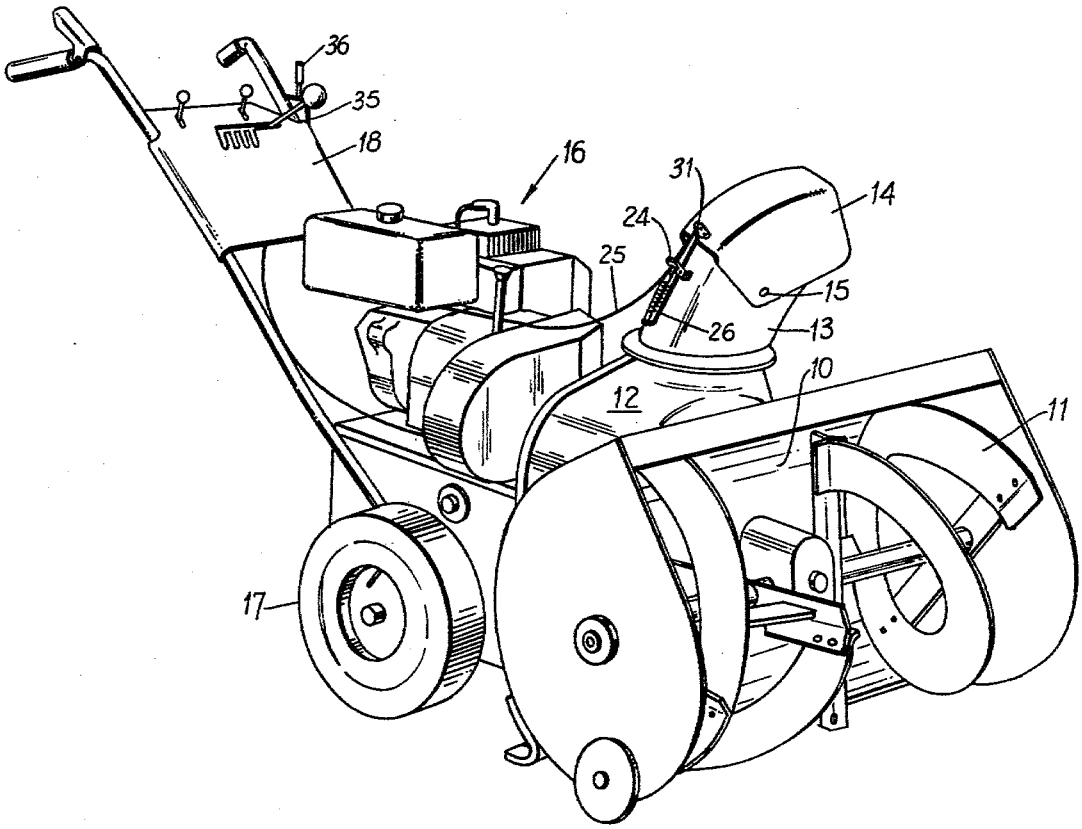
Figure 2:
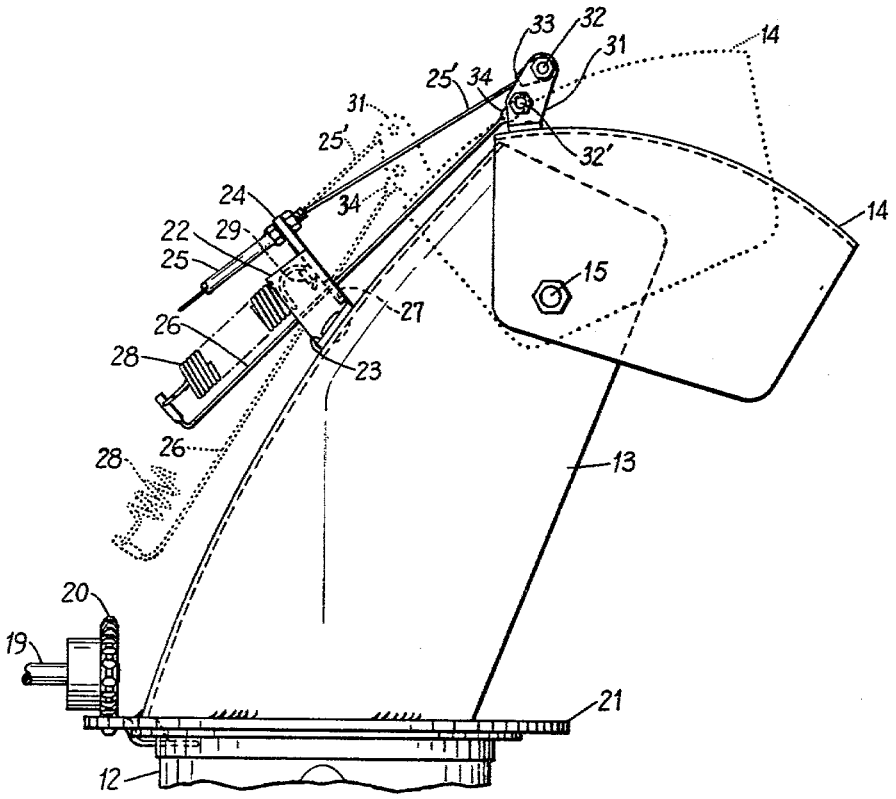
Figure 3:
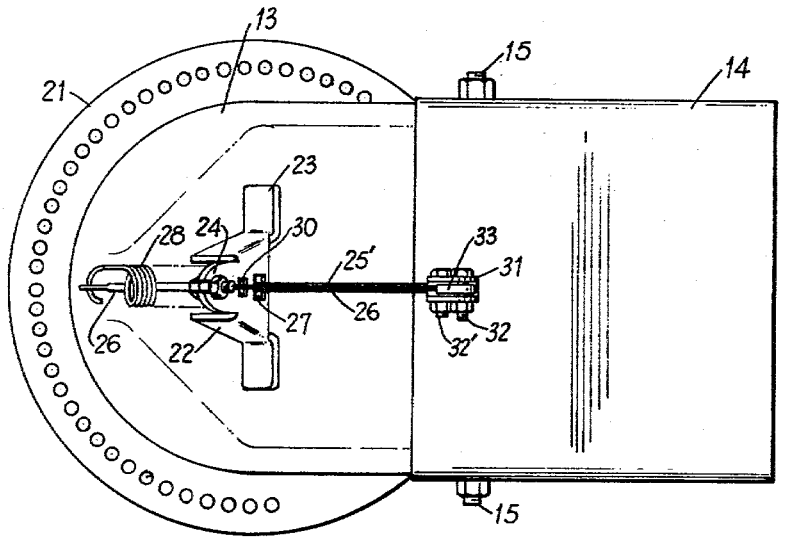

The invention and further advantages thereof will be best understood by considering the following description of an embodiment thereof shown in the attached two sheets of drawings in which FIG. 1 is a perspective view of a blower having the invention incorporated therein, FIG. 2 is an enlarged side view of the adjustable discharge chute-deflector portion thereof, and FIG. 3 is a top view of the mechanism shown in FIG. 2.

Referring now first to FIG. 1, shown therein is a conventional type two-stage snow blower currently available on the market. The first stage comprises an auger chamber 10 having an auger 11 therein, and a second stage comprising a blower chamber 12 having a not shown snow blower impellar therein. The second stage empties the snow into a discharge chute 13 which is capped by a deflector 14 which is pivoted on an axis or pins 15.

The snow blower includes an engine 16 for powering the two stages. The whole unit is movably mounted on a pair of rear wheels 17 which may or may not be driven by the engine 16. A handle assembly extends rearwardly from the unit and includes a control panel 18 and various controls for the unit. Of course, the operator's position or station is behind the handle assembly and at the controls thereof.

Referring now also to FIGS. 2 and 3, the chute 13 can be rotated about its axis. This is conventional in the art and briefly is done by rotating a shaft 19 which has a toothed wheel 20 that engages an apertured flange 21 on the bottom rotatable mounting of the chute 13 to the chamber 12. That is to say, when shaft 19 is turned in either direction, the meshed parts 20, 21 cause the chute 13 to turn. Of course, the shaft 19 preferably is rotated by a control located at the rear of the unit so the operator does not have to leave his position behind the control panel 18. Anyway, the shaft 19 controls discharge of snow to left or right, or straight ahead. The position of deflector 14 determines discharge of snow up or down or straight ahead.

The position of deflector 14 is controlled by a mechanism mounted on the back of the chute 13. Briefly, this deflector control mechanism comprises a generally U-shaped bracket 22, see FIG. 3, having a pair of bottom mounting pads 23 with which to mount the bracket to the chute 13. The bracket 22 also includes a top tab 24, see FIG. 2, with which to dead end the sheath 25 of an operating cable 25'.

A fore and aft diagonally extending rod 26 extends through the bite portion of bracket 22 through a round aperture 27 which is amply oversize with respect to the diameter of the rod 26 so that rod 26 will not bind in aperture 27 even though the angle of rod 26 may change somewhat (compare the solid and dotted line positions for rod 26 illustrated in FIG. 2).

A spring 28 is positioned above the rod 26. The rear end of rod 26 is L-shaped and the rear end of spring 28 hooked thereon. The front end of spring 28 is hooked on to a tab 29 punched out of the bracket 22 at a square hole 30 located between the round hole 27 and the tab 24.

Another U-shaped bracket 31 is mounted to the back of deflector 14 adjacent its rear edge. The cable 25' is dead ended to the bracket 31 by pin 32 on the bracket and an eyelet 33 on the cable. The upper end of rod 26 has an eyelet 34 formed thereon which is connected to another pin 32' below the cable pin 32.

Thus, when cable 25' is pulled rearwardly, the deflector 14 is rocked rearwardly about the axis or pins 15 to direct the discharged snow upwardly. When cable 25' is pulled rearwardly, it simultaneously pulls the rod 26 rearwardly, which causes the coil spring 28 to be tensioned. Thus, if cable is released, the tensioned spring will automatically, and in a positive fashion, move the rod forwardly to lower the deflector 14 to decrease the angle of elevation of the snow discharge from the chute 14. So, the device besides having a minimum number of parts is positive acting in both directions. The fact that it has very few parts means that is is less apt to stick or jam.

The sheathed cable 25, 25' extends rearwardly from the chute 13 to the handle assembly (see FIG. 1) and there its sheath is dead ended to a bracket 35 and its cable connected to an operating handle 36 which has indented positions or stops, in a manner which will be obvious to those skilled in the art, to hold the deflector 14 in its selected adjusted position. Preferably the arrangement of the parts is such that when handle 36 is raised, the cable 25' is pulled to raise the deflector 14, and when it is lowered, the cable 25' is released to lower the deflector. In other words, raising the handle 36 will result in raising the angle of snow discharge, and lowering the handle will lower the angle of snow discharge.

I claim:

1. In a snow blower discharge chute having an adjustable pivoted deflector thereon, operating mechanism for said deflector which is adapted to be controlled from a position remote from said chute, said mechanism comprising a bracket on said chute, a rod slideable through said bracket, the front end of said rod being connected to said deflector, a tension spring which is anchored at its opposite ends to said bracket and the rear end of said rod, and an operating cable extending from its rear end at a location remote from said chute through said bracket and to said deflector at its front end to pull said deflector rearwardly to elevate the angle of snow discharged from said chute, rearward movement of said deflector by said cable operating to move said rod rearwardly to tension said spring whereby release of said cable results in positive forward movement of said rod and deflector to decrease the angle of elevation of snow discharged from said chute.

2. In a snow blower, as in claim 1, said rod being slideable through said bracket through a hole in said bracket, said hole being oversize with respect to the cross section of said rod whereby said rod is less apt to stick or jam in said bracket during its movement with respect thereto.

3. In a snow blower, as in claim 2, said rod, spring and cable being lengthwise aligned one above the other in a common plane in the sequence of rod bottommost, then the spring, and the cable uppermost, and another bracket on said deflector, and eyelet means on the front ends of said rod and cable for connecting the same to said deflector at said another bracket, said cable being connected to said another bracket at a position above the rod connection to said another bracket.

* * * * *